US010389055B1

(12) United States Patent
Lui et al.

(10) Patent No.: US 10,389,055 B1
(45) Date of Patent: Aug. 20, 2019

(54) ELECTRICAL CONNECTOR ASSEMBLY

(71) Applicant: Delphi Technologies, LLC, Troy, MI (US)

(72) Inventors: Hoi Lui, Warren, OH (US); Patrick J. Reedy, Youngstown, OH (US); Steven W. Marzo, Cortland, OH (US); Michael L. Mellott, Youngstown, OH (US)

(73) Assignee: DELPHIA TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 16/012,907

(22) Filed: Jun. 20, 2018

(51) Int. Cl.

| | |
|---|---|
| ***H01R 13/18*** | (2006.01) |
| ***H01R 13/187*** | (2006.01) |
| ***H01R 11/22*** | (2006.01) |
| ***H01R 4/18*** | (2006.01) |
| *H01R 13/44* | (2006.01) |

(52) U.S. Cl.
CPC ..... *H01R 13/187* (2013.01); *H01R 4/182* (2013.01); *H01R 4/187* (2013.01); *H01R 11/22* (2013.01); *H01R 13/44* (2013.01)

(58) Field of Classification Search
CPC ..... H01R 13/187; H01R 11/22
See application file for complete search history.

(56) References Cited

U.S. PATENT DOCUMENTS 5,588,884 A * 12/1996 Rudoy ..... H01R 13/187 439/787
5,679,034 A * 10/1997 Hanazaki ..... H01R 13/187 439/845
7,766,706 B2 8/2010 Kawamura et al.
7,789,720 B2 9/2010 Zinn
9,142,902 B2 9/2015 Glick et al.
9,300,069 B2 3/2016 Morello et al.
9,537,227 B1 1/2017 Morello et al.
9,905,950 B2 * 2/2018 Marsh ..... H01R 13/113
2002/0025732 A1 * 2/2002 Hsieh ..... H01R 13/187 439/845
2004/0040733 A1 * 3/2004 Yuasa ..... H01R 13/17 174/68.2
2007/0066152 A1 * 3/2007 Mohs ..... H01R 13/113 439/843
2007/0218736 A1 * 9/2007 Takizawa ..... H01R 11/01 439/247
2016/0285178 A1 * 9/2016 Wimmer ..... H01R 4/489
2017/0062955 A1 * 3/2017 Marsh ..... H01R 13/113
2019/0013609 A1 * 1/2019 Kimura ..... H01R 13/2421

* cited by examiner

*Primary Examiner* — James Harvey
(74) *Attorney, Agent, or Firm* — Robert J. Myers

(57) ABSTRACT

An electrical connector assembly includes a planar terminal portion formed of a copper-based material having a connection end and an attachment end. The assembly also includes a U-shaped retainer portion having a first side wall attached to the connection end, a second side wall separated from and substantially parallel to the first side wall, and an end wall interconnecting the first side wall and the second side wall. The connection end is located intermediate the first side wall and the second side wall. The assembly further includes a resilient spring disposed intermediate the second side wall and the terminal portion and attached to the second side wall. The spring is configured to exert a normal connection force on the connection end and a mating connector inserted into a gap between the spring and the connection end.

25 Claims, 9 Drawing Sheets

ELECTRICAL CONNECTOR ASSEMBLY

TECHNICAL FIELD OF THE INVENTION

The invention generally relates to an electrical connector assembly.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

An electrical connector assembly suitable for high current applications, e.g. greater than 200 amperes, is presented herein. The electrical connect assemblies forms a direct current path between one planar copper blade terminal in a first electrical connector and a second planar copper blade terminal in a second electrical connector. The terminals are held in place by a retainer portion of the first electrical connector and a normal force is applied to the terminals by a spring located between the retainer portion and the second blade terminal.

Figure 1:
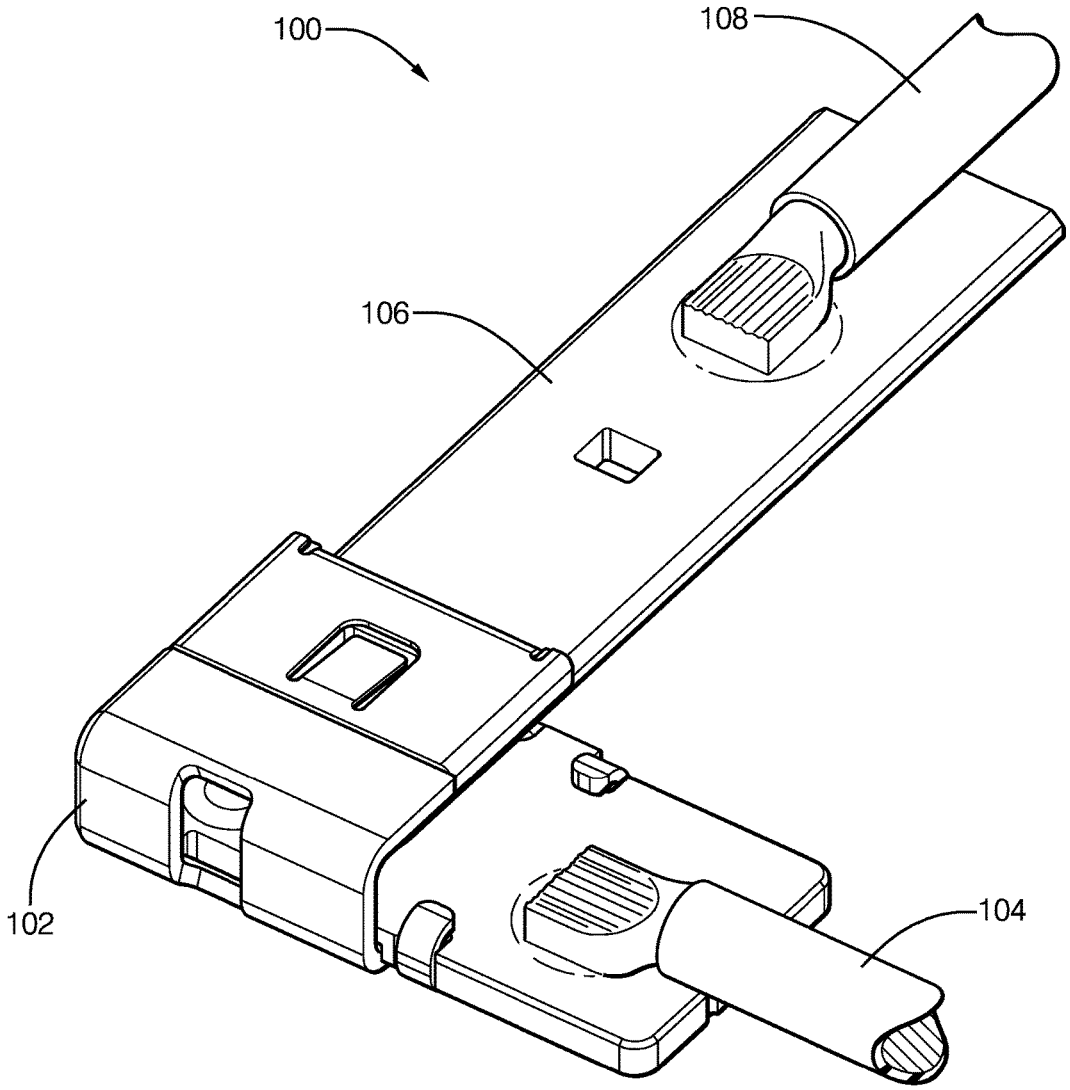
FIG. 1 is a perspective view of an electrical connector assembly, according to a first embodiment.
Figure 2:
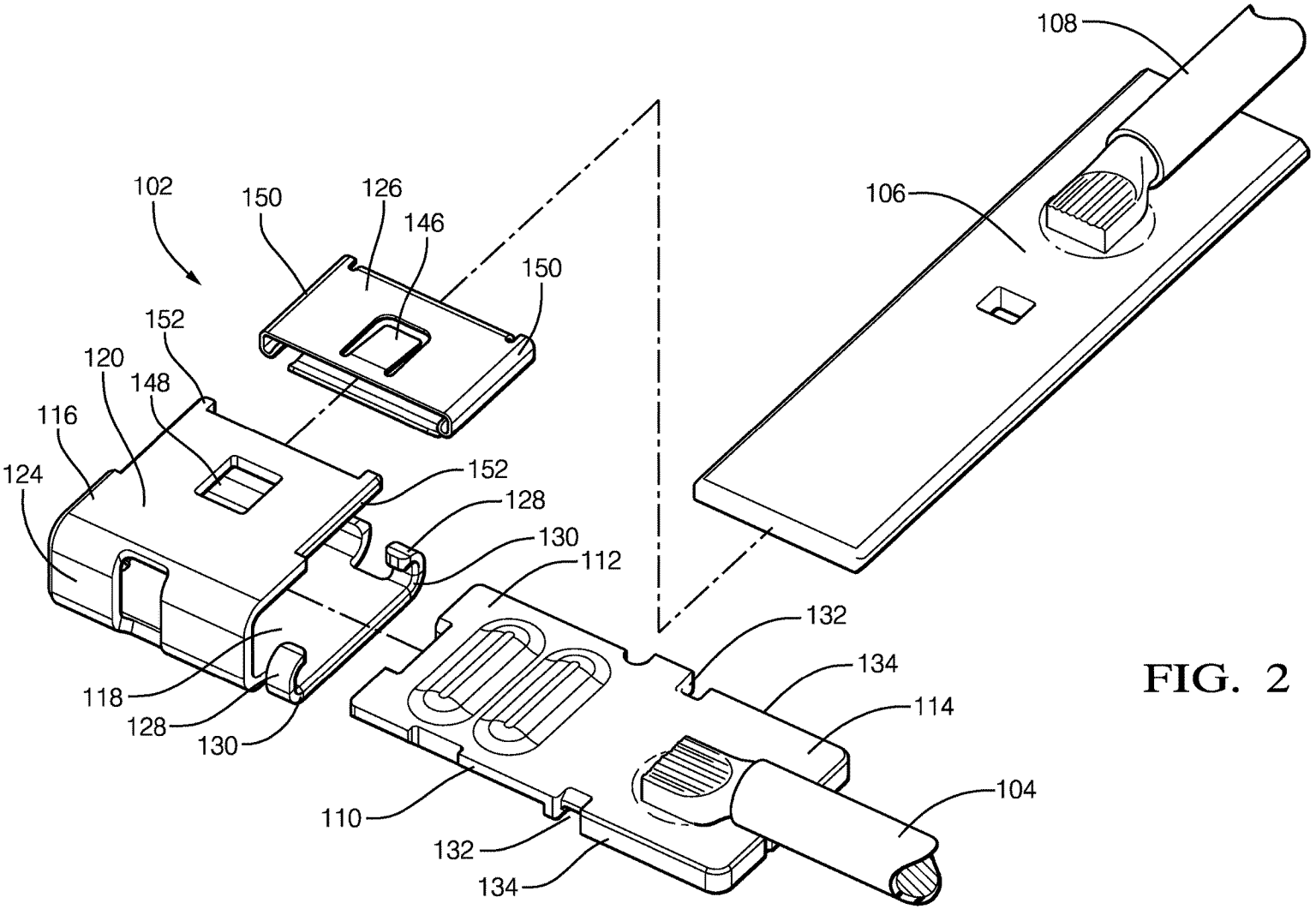
FIG. 2 is an exploded view of the electrical connector assembly of FIG. 1, according to the first embodiment.

FIGS. 1 and 2 illustrate a electrical connector assembly, hereinafter referred to as the assembly 100, according to an embodiment of this invention. The assembly 100 includes an electrical connector, hereinafter referred to as the connector 102, attached to a wire cable 104 and a mating electrical connector, hereinafter referred to as the mating connector 106, attached to another wire cable 108.

Figure 3A:
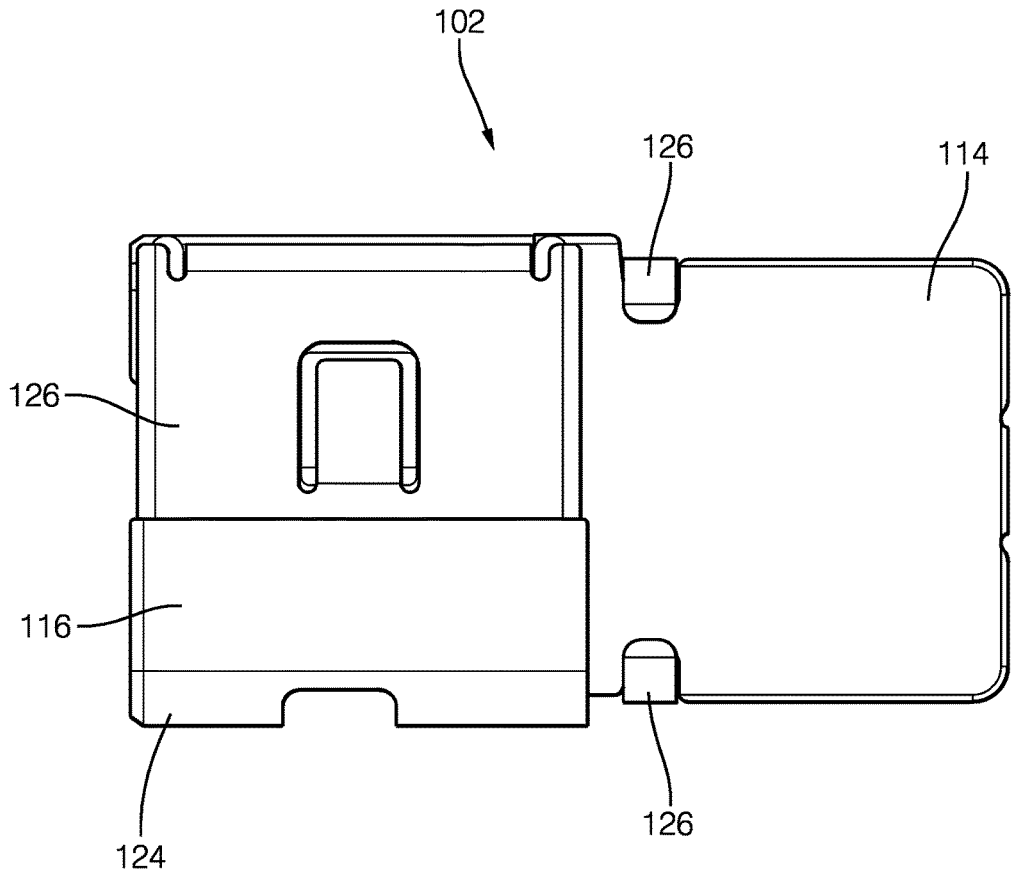
FIG. 3A is a top view of one of the electrical connectors of the electrical connector assembly of FIG. 1, according to the first embodiment.
Figure 3B:
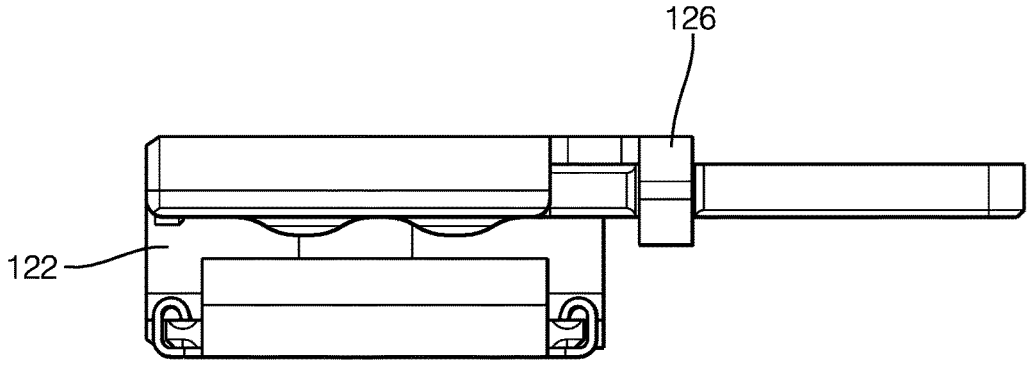
FIG. 3B is a side of the electrical connector of FIG. 3A, according to the first embodiment.

As shown in FIGS. 3A and 3B, the connector 102 includes a generally planar blade terminal portion, hereinafter referred to as the terminal portion 110 that extends along a longitudinal axis X. The terminal portion 110 is formed of a copper-based material that may be elemental copper or a copper alloy in which copper is the primary constituent. The mating connector 106 is also a planar blade terminal formed of a copper based material. The terminal portion 110 has a connection end 112 that is in physical and electrical contact with the mating connector 106 when the assembly 100 is connected. The terminal portion 110 also has an attachment end 114 to which the wire cable 104 is attached. In the illustrated example of FIGS. 1 and 2, the wire cable 104 is attached using a sonic welding process. Alternative embodiments of the connector may be envisioned wherein the wire cable is attached within a ferrule, by crimping wings, or other cable attachment means know to those skilled in the art.

Returning to FIGS. 3A and 3B, the connector 102 also includes a U-shaped retainer portion, hereinafter referred to as the retainer portion 116 having a first side wall 118 attached to the connection end 112 of the terminal portion 110, a second side wall 120 that is separated from the first side wall 118 by a gap 122 and is substantially parallel to the first side wall 118, and an end wall 124 interconnecting the first side wall 118 and the second side wall 120. As used herein, substantially parallel means±15° of absolutely parallel. The connection end 112 is located intermediate the first side wall 118 and the second side wall 120. The connector 102 further includes a resilient spring, hereinafter referred to as the spring 126, that is disposed intermediate the second side wall 120 and the terminal portion 110. The spring 126 is attached to the second side wall 120. The spring 126 is configured to exert a normal connection force on the connection end 112 and the mating connector 106 when it is inserted into the gap 122 between the spring 126 and the connection end 112, thereby providing a more robust and lower resistance connection between the connector 102 and the mating connector 106.

Figure 4:
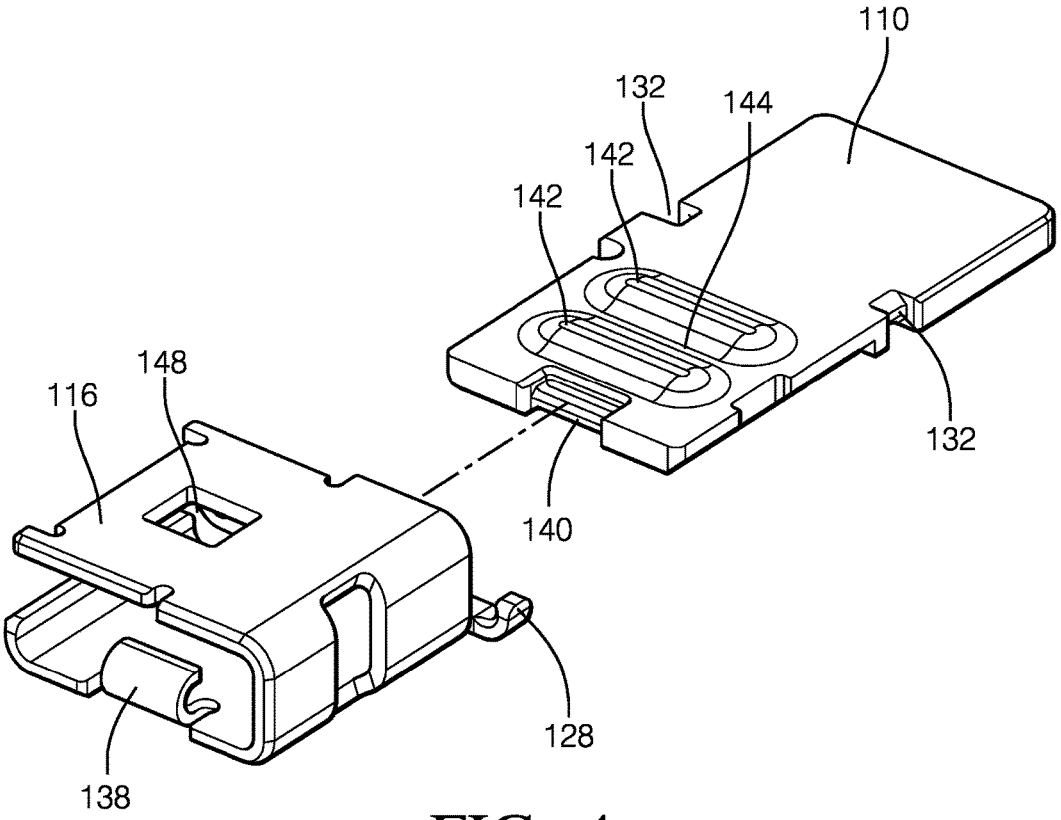
FIG. 4 is a pre-assembly view of the electrical connector of FIG. 3A, according to the first embodiment.
Figure 5:
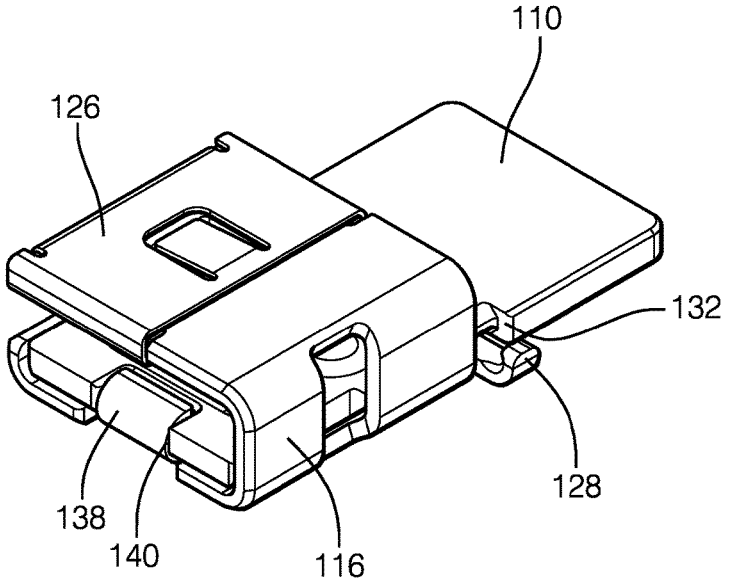
FIG. 5 is an intermediate assembly view of the electrical connector of FIG. 3A, according to the first embodiment.
Figure 6:
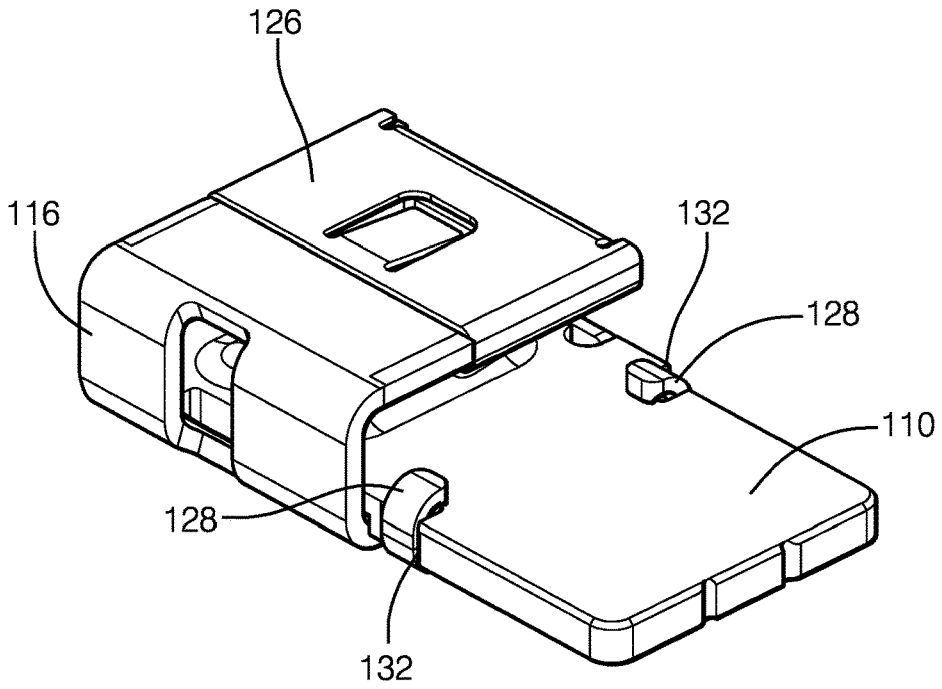
FIG. 6 is an assembly view of the electrical connector of FIG. 3A, according to the first embodiment.
Figure 7:
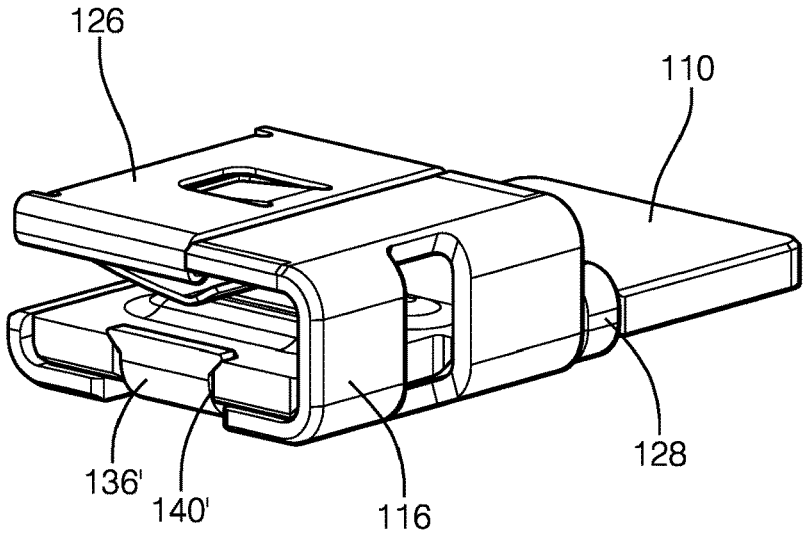
FIG. 7 is a perspective view of one of the electrical connectors of the electrical connector assembly of FIG. 1, according to a second embodiment.

As shown in FIGS. 4-6, the retainer portion 116 is attached to the terminal portion 110 by side tabs 128 extending from distal edges 130 of the first side wall 118 that are received within side slots 132 defined in the distal edges 134 of the attachment end 114 and crimped over the attachment end 114. The retainer portion 116 is further attached to the terminal portion 110 by an end tab 136 that extends from an end 138 of the first side wall 118 and is received within an end slot 140 defined in the connection end 112 and is crimped over the connection end 112. In an alternative embodiment shown in FIG. 7, the end tab 136' has a dovetail shape that is received within the end slot 140'. In other alternative embodiments, the retainer portion may be welded to the terminal portion, e.g. using a laser or resistance welding process.

As best shown in FIG. 4, the connection end 112 of the terminal portion 110 defines a plurality of raised ridges 142. The ridges 142 are configured to improve the electrical contact between the connector 102 and the mating connector 106. In the illustrated example, these ridges 142 extending laterally across a mesial portion 144 of the connection end 112. These ridges 142 may preferably be formed by an embossing process. While the terminal portion 110 of the illustrated example defines the ridges 142, alternative embodiments of the assembly may be envisioned in which the mating terminal defines a plurality of ridges.

Figure 8:
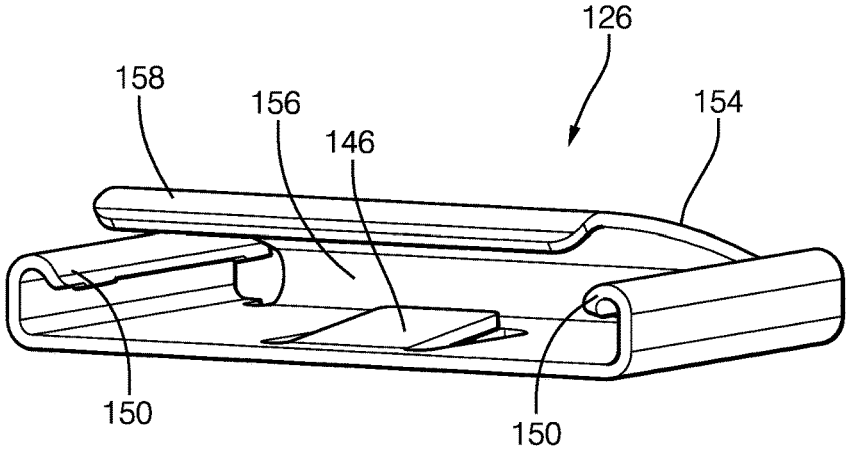
FIG. 8 is a perspective view of a spring of the electrical connector of FIG. 3A, according to the first embodiment.
Figure 9:
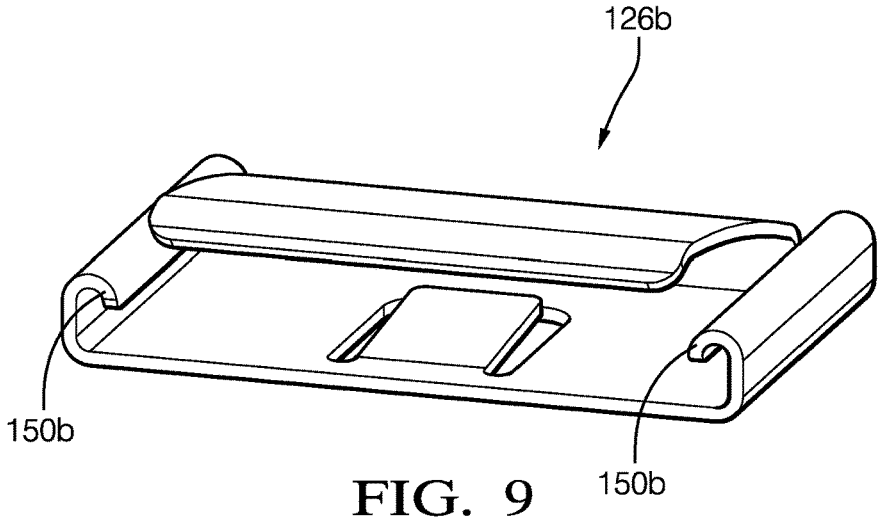
FIG. 9 is a perspective view of a spring of the electrical connector, according to a third embodiment.
Figure 10:
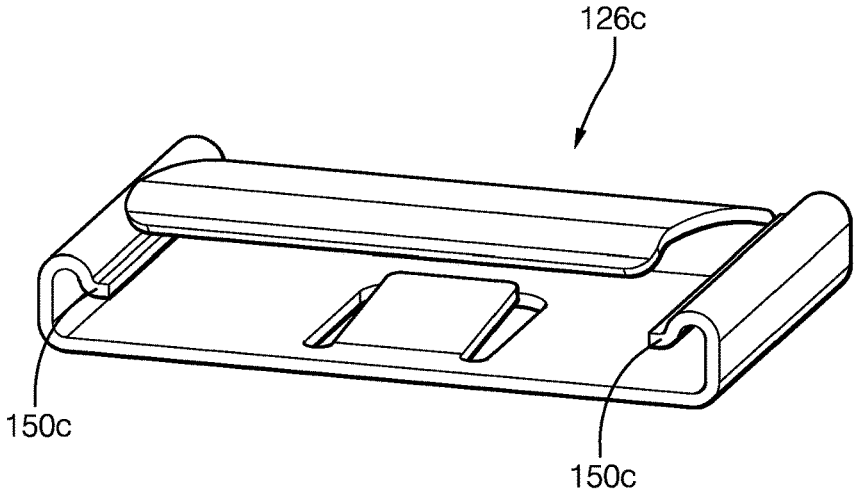
FIG. 10 is a perspective view of a spring of the electrical connector, according to a fourth embodiment.
Figure 11:
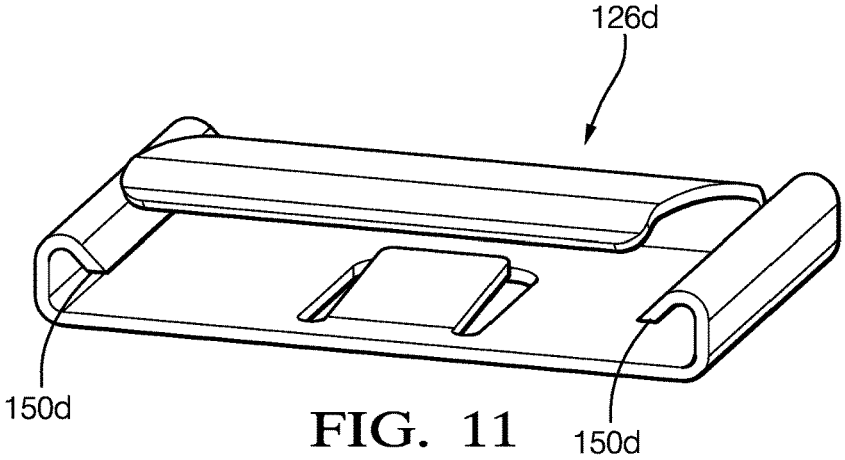
FIG. 11 is a perspective view of a spring of the electrical connector, according to a fifth embodiment.

The spring 126 is secured to the second side wall 120 by a flexible tang 146, best shown in FIG. 8, that is received within an aperture 148 defined in the second side wall 120, best shown in FIGS. 2 and 4. The spring 126 also includes retaining rails 150 that wrap around the edges 152 of the second side wall 120. The height of these retaining rails 150 inhibit over-deflection of the spring 126 by the mating terminal. The retaining rails illustrated in FIG. 8 have a scalloped lower edge to provide a controller interference fit between the spring 126 and the second side wall 120. Alternatively, the lower edge of the retaining rails 150*b* of the spring 126*b* may be flat as shown in FIG. 9, the lower edge of the retaining rails 150*c* of the spring 126*c* may be widened as shown in FIG. 10, or the lower edge of the retaining rails 150*d* of the spring 126*d* may be angled as shown in FIG. 11. In alternative embodiments, the spring may be attached to the second side wall by a welding process, e.g. a laser or resistance welding process.

Figure 12:
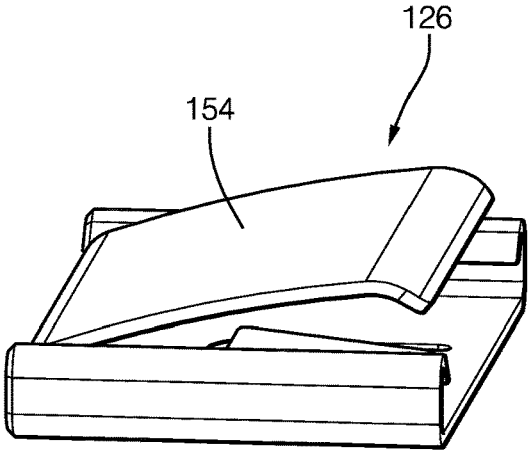
FIG. 12 is an alternate perspective view of the spring of FIG. 8, according to the first embodiment.
Figure 13:
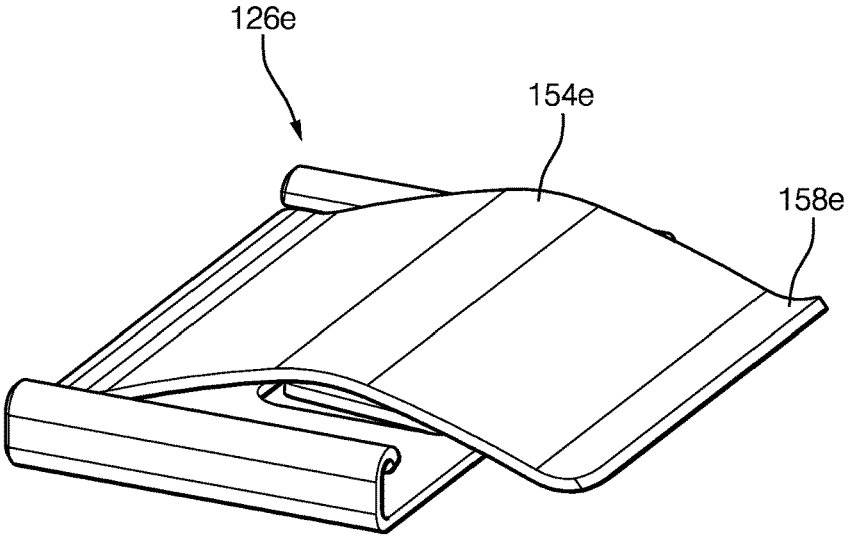
FIG. 13 is a perspective view of a spring of the electrical connector, according to a sixth embodiment.
Figure 14:
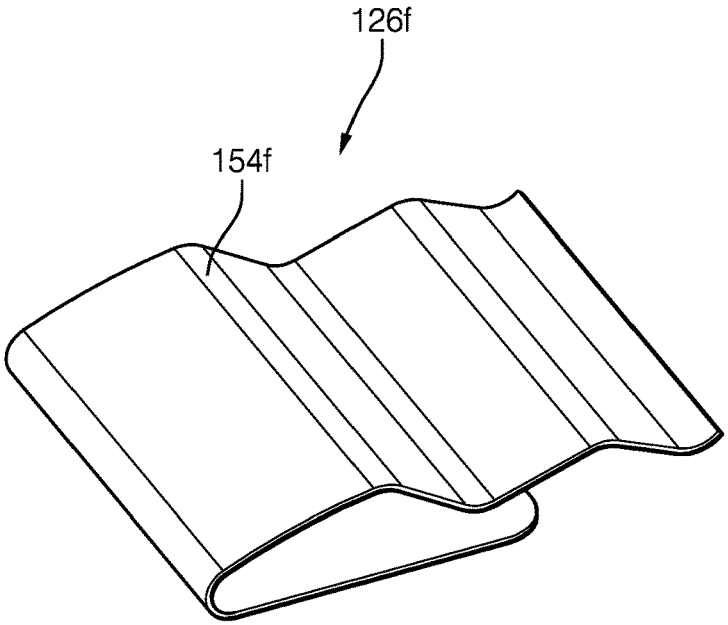
FIG. 14 is a perspective view of a spring of the electrical connector, according to a seventh embodiment.

The spring 126 defines a cantilevered plate 154 that has a fixed end 156 attached to the second side wall 120 and a free end 158 extending into the gap 122 between the spring 126 and the connection end 112. The height of the retaining rails 150 inhibit over-deflection of the cantilevered plate 154 by the mating terminal. In an example embodiment of the spring 126 shown in FIG. 12, the plate 154 is characterized as having an arcuate shape. In another example embodiment of the spring 126*e* shown in FIG. 13, the free end 158*e* of the plate 154*e* extends further toward the second side wall 120 and is configured to be in slideable contact with the second side wall 120. In yet another example embodiment of the spring 126*f* shown in FIG. 14, the plate 154*f* comprises a W-shaped section.

Figure 15:
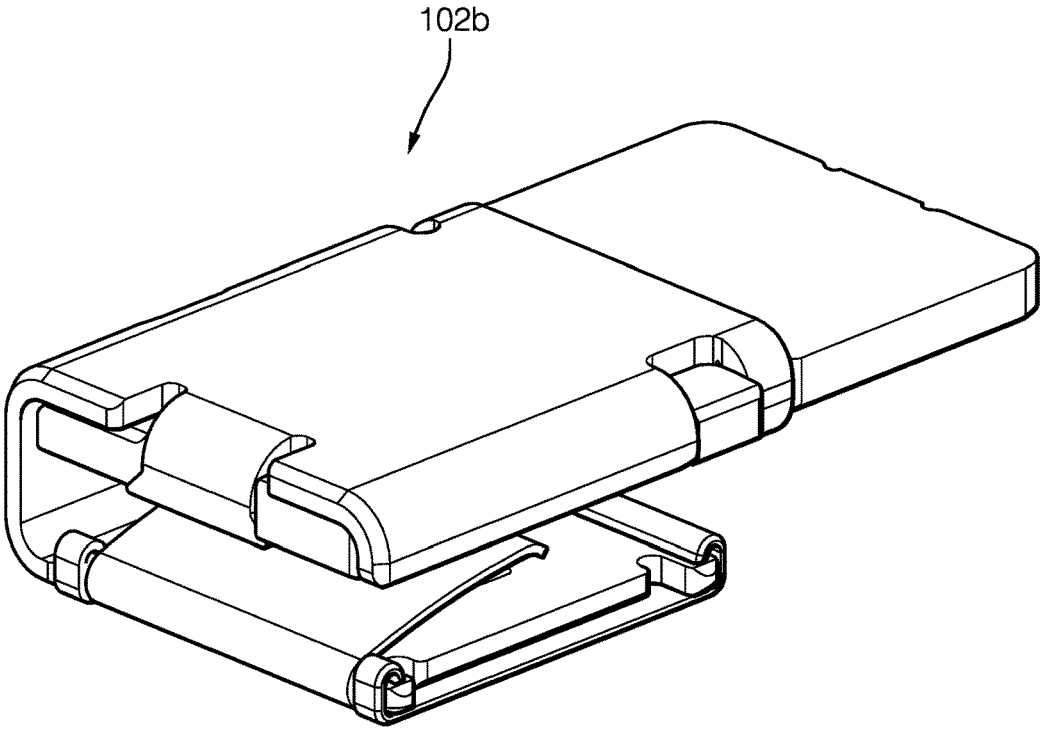
FIG. 15 is a perspective view of a spring of the electrical connector assembly of FIG. 1 including a finger protection device, according to an eighth embodiment.

The illustrated example of the assembly 100 is a right angle or ninety degree connector assembly wherein the mating axis of the mating connector 106 is orthogonal to the longitudinal axis of the terminal portion 110 of the connector 102. In this embodiment, the end wall 124 extends longitudinally along a distal edge of the connection end 112. Other embodiments of the assembly shown in FIG. 15 is a straight connector assembly in which the mating axis of the mating connector is parallel to the longitudinal axis X of the connector 102*b*.

Figure 16:
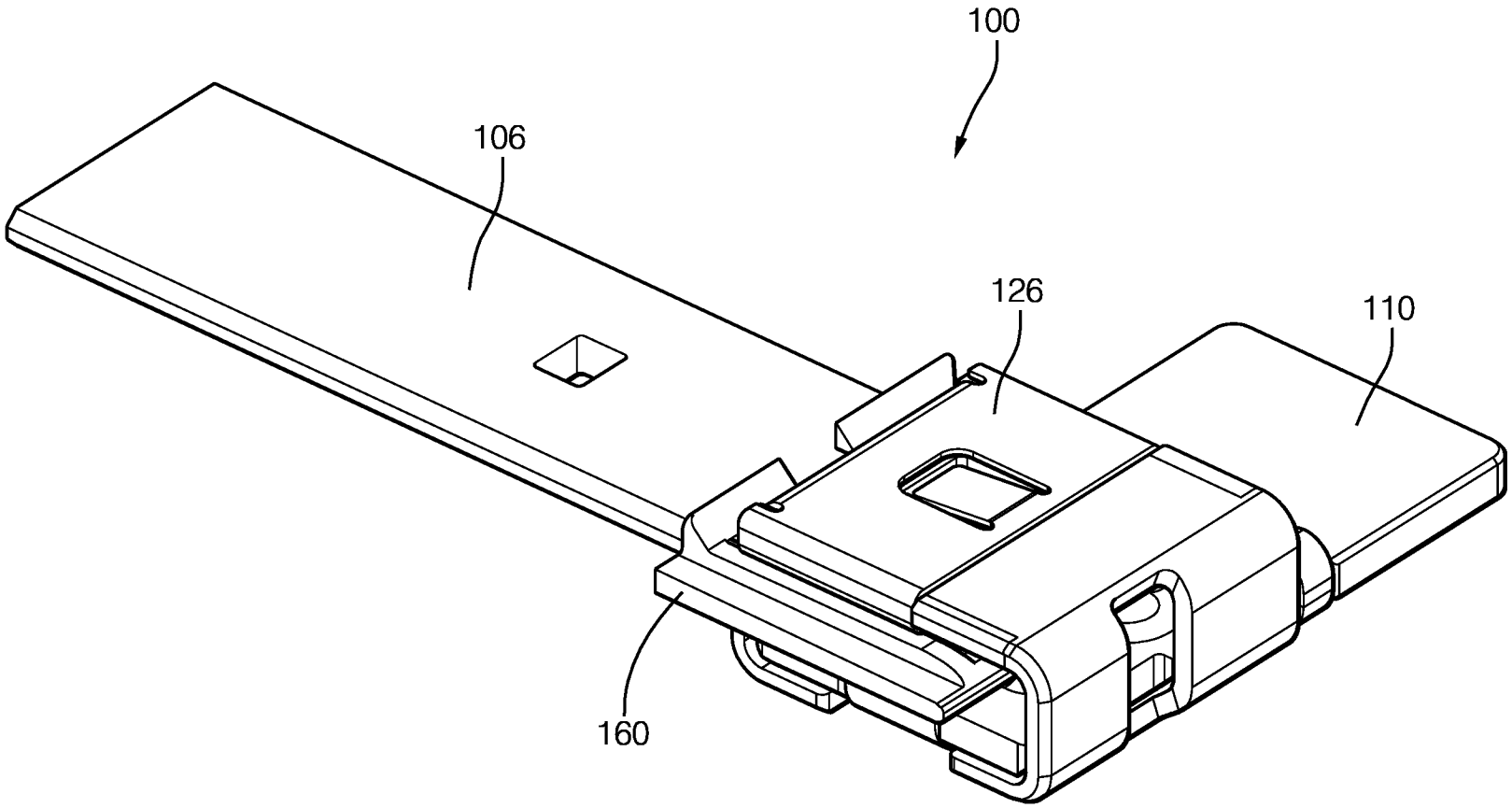
FIG. 16 is an electrical connector assembly, according to a ninth embodiment.

In an alternative embodiment illustrated in FIG. 16, the assembly 100 also includes a finger protection device 160 that is formed of a dielectric material, such as a high temperature polymer material, that is disposed intermediate the spring 126 and the mating connector 106. The finger protection device 160 extends beyond the edge of the second side wall 120 to inhibit inadvertent contact between an assembler or service technician and an energized connector 102.

Without subscribing to any particular theory of operation, because the terminal portion 110 and the mating connector 106 are in direct physical and electrical contact, the majority of the current flowing through the assembly 100 will flow thought these two components, therefore the electrical conductivity of the retainer portion 116 and the spring 126 are not critical to the current carrying capability of the assembly 100. The material used for the retainer portion 116 and the spring 126 may be selected for their mechanical properties rather than their electrical properties, allowing the use of high temperature stainless steel materials or even high temperature polymer material that can provide sufficient normal contact force between the connector 102 and the mating connector 106. These materials may also have a lower cost than the copper-based material used to form the terminal portion 110 and the mating connector 106.

Accordingly, an electrical connector assembly is provided. The assembly provide the benefit of a direct current path between to copper blade terminals. The assembly reduces the copper material used compared to prior art designs, increases the cross sectional area of the terminals, and allows for use of lower cost materials for structural components of the assembly, such as the retainer portion and spring.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector assembly, comprising:

an electrical connector, having:

a generally planar terminal portion extending along a longitudinal axis, said terminal portion formed of a copper-based material and having a connection end and an attachment end, a U-shaped retainer portion having a first side wall attached to the connection end, a second side wall separated from and substantially parallel to the first side wall, and an end wall interconnecting the first side wall and the second side wall, wherein the connection end is intermediate the first side wall and the second side wall, and a resilient spring disposed intermediate the second side wall and the connection end and attached to the second side wall, said spring configured to exert a normal connection force on the connection end and a planar mating connector inserted into a gap between the spring and the connection end wherein the mating connector extends along a mating axis and has an insertion end and a joining end;

a wire cable attached to the attachment end; and another wire cable attached to the joining end, wherein the mating axis is substantially orthogonal to the longitudinal axis.

2. An electrical connector assembly, comprising:

an electrical connector, having:

a generally planar terminal portion extending along a longitudinal axis, said terminal portion formed of a copper-based material and having a connection end and an attachment end, a U-shaped retainer portion having a first side wall attached to the connection end, a second side wall separated from and substantially parallel to the first side wall, and an end wall interconnecting the first side wall and the second side wall, wherein the connection end is intermediate the first side wall and the second side wall, and a resilient spring disposed intermediate the second side wall and the connection end and attached to the second side wall, said spring configured to exert a normal connection force on the connection end and a planar mating connector inserted into a gap between the spring and the connection end wherein the mating connector extends along a mating axis and has an insertion end and a joining end;

a wire cable attached to the attachment end;

another wire cable attached to the joining end; and a finger protection device formed of a dielectric material disposed intermediate the spring and the mating connector, said finger protection device extends beyond a distal edge of the second side wall.

3. An electrical connector, comprising:

a generally planar terminal portion extending along a longitudinal axis, said terminal portion formed of a copper-based material and having a connection end and an attachment end;

a U-shaped retainer portion having a first side wall attached to the connection end, a second side wall separated from and substantially parallel to the first side wall, and an end wall interconnecting the first side wall and the second side wall, wherein the connection end is intermediate the first side wall and the second side wall, wherein the retainer portion is attached to the terminal portion by side tabs extending from distal edges of the first side wall that are received within side slots defined in distal edges of the attachment end and crimped over the attachment end and by an end tab extending from an end of the first side wall that is received within an end slot defined in the connection end; and a resilient spring disposed intermediate the second side wall and the connection end and attached to the second side wall, said spring configured to exert a normal connection force on the connection end and a planar mating connector inserted into a gap between the spring and the connection end.

4. An electrical connector, comprising:

a generally planar terminal portion extending along a longitudinal axis, said terminal portion formed of a copper-based material and having a connection end and an attachment end, wherein the connection end defines a plurality of raised ridges extending laterally across a mesial portion of the connection end;

a U-shaped retainer portion having a first side wall attached to the connection end, a second side wall separated from and substantially parallel to the first side wall, and an end wall interconnecting the first side wall and the second side wall, wherein the connection end is intermediate the first side wall and the second side wall; and a resilient spring disposed intermediate the second side wall and the connection end and attached to the second side wall, said spring configured to exert a normal connection force on the connection end and a planar mating connector inserted into a gap between the spring and the connection end.

5. The electrical connector according to claim 3, wherein the end wall extends longitudinally along a distal edge of the connection end.

6. The electrical connector according to claim 3, wherein the spring is secured to the second side wall by a flexible tang received within a aperture defined in the second side wall.

7. The electrical connector according to claim 3, wherein the spring defines a cantilevered plate having a fixed end and a free end extending into the gap between the spring and the connection end.

8. The electrical connector according to claim 7, wherein the plate is characterized as having an arcuate shape.

9. An electrical connector, comprising:

a generally planar terminal portion extending along a longitudinal axis, said terminal portion formed of a copper-based material and having a connection end and an attachment end;

a U-shaped retainer portion having a first side wall attached to the connection end, a second side wall separated from and substantially parallel to the first side wall, and an end wall interconnecting the first side wall and the second side wall, wherein the connection end is intermediate the first side wall and the second side wall; and a resilient spring disposed intermediate the second side wall and the connection end and attached to the second side wall, said spring configured to exert a normal connection force on the connection end and a planar mating connector inserted into a gap between the spring and the connection end, wherein the spring defines a cantilevered plate having a fixed end and a free end extending into the gap between the spring and the connection end and wherein the free end is in slideable contact with the second side wall.

10. The electrical connector according to claim 9, wherein the plate comprises a W-shaped section.

11. An electrical connector assembly, comprising:

the electrical connector according to claim 3; and a wire cable attached to the attachment end.

12. The electrical connector assembly according to claim 11, wherein the wire cable is welded to the attachment end.

13. The electrical connector assembly according to claim 12, wherein the wire cable is sonically welded to the attachment end.

14. The electrical connector assembly according to claim 11, wherein the mating connector extends along a mating axis and has an insertion end and a joining end and wherein the electrical connector assembly further compromises another wire cable attached to the joining end.

15. The electrical connector assembly according to claim 14, wherein the mating connector is disposed intermediate the spring and the connection end.

16. An electrical connector assembly, comprising:

the electrical connector according to claim 4; and a wire cable attached to the attachment end.

17. The electrical connector according to claim 9, wherein the spring defines a cantilevered plate having a fixed end and a free end extending into the gap between the spring and the connection end.

18. The electrical connector according to claim 4, wherein the end wall extends longitudinally along a distal edge of the connection end.

19. The electrical connector according to claim 4, wherein the spring is secured to the second side wall by a flexible tang received within a aperture defined in the second side wall.

20. The electrical connector according to claim 4, wherein the spring defines a cantilevered plate having a fixed end and a free end extending into the gap between the spring and the connection end.

21. The electrical connector according to claim 20, wherein the plate is characterized as having an arcuate shape.

22. The electrical connector according to claim 9, wherein the end wall extends longitudinally along a distal edge of the connection end.

23. The electrical connector according to claim 9, wherein the spring is secured to the second side wall by a flexible tang received within a aperture defined in the second side wall.

24. An electrical connector assembly, comprising:

the electrical connector according to claim 9; and a wire cable attached to the attachment end.

25. The electrical connector according to claim 17, wherein the plate is characterized as having an arcuate shape.

* * * * *